US007607488B2

(12) United States Patent
Durham

(10) Patent No.: US 7,607,488 B2
(45) Date of Patent: Oct. 27, 2009

(54) AUTOMATIC STOVE TOP FIRE EXTINGUISHER

(76) Inventor: Thomas Joe Durham, P.O. Box 742, Hillsboro, TX (US) 76645

( * ) Notice: Subject to any disclaimer, the term of this patent is extended or adjusted under 35 U.S.C. 154(b) by 0 days.

(21) Appl. No.: 12/055,534

(22) Filed: Mar. 26, 2008

(65) Prior Publication Data

US 2008/0245538 A1 Oct. 9, 2008

Related U.S. Application Data

(60) Provisional application No. 60/910,670, filed on Apr. 8, 2007.

(51) Int. Cl.
*A62C 3/00* (2006.01)
*A62C 37/00* (2006.01)
*A62C 2/00* (2006.01)

(52) U.S. Cl. ..... 169/46; 169/42; 169/48; 169/49; 169/56; 169/65

(58) Field of Classification Search ..... 169/23, 169/42, 43, 45, 46, 48, 49, 54, 56, 57, 59, 169/65

See application file for complete search history.

(56) References Cited

U.S. PATENT DOCUMENTS 3,209,837 A * 10/1965 Freedman ..... 169/42
3,653,443 A * 4/1972 Dockery ..... 169/61
4,580,638 A * 4/1986 Jones et al. ..... 169/49
5,490,567 A * 2/1996 Speer ..... 169/50

* cited by examiner

*Primary Examiner*—Darren W Gorman

(57) ABSTRACT

A fire extinguishing system for use with gas or electric range stove top to automatically deploy and energize an audible alarm. The system includes a pressurized supply of inert gas within an inflatable bag. A grease fire on the stove top breaks the fusible cord and allows the case to open, releasing the inert gas supply. The inert gas inflates a flame resistant bag to cover the burners of the stove top. The bottom of the flame resistant bag is a specific temperature sensitive material that will decompose on contact with the grease fire. As the bottom decomposes, the flame resistant material surrounds the cooking container containing the grease fire. The grease fire becomes isolated by flame resistant materials and inert gas. The bottom two layers of the bag have an additional layer of non-flammable absorbent fiber between the two layers of the decomposing bottom. The decomposing bottom layer releases the non-flammable absorbent fiber into the cooking container containing the extinguished grease fire to absorb the cooking grease and prevent the cooking grease from re-igniting.

13 Claims, 9 Drawing Sheets

Fig. 9, Fig. 10, Fig. 11 and Fig. 12
Fig. 9
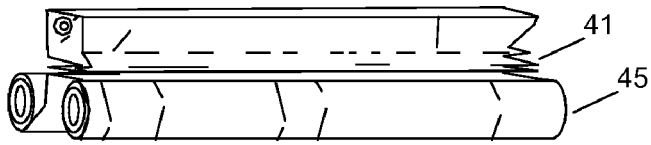
Fig. 10
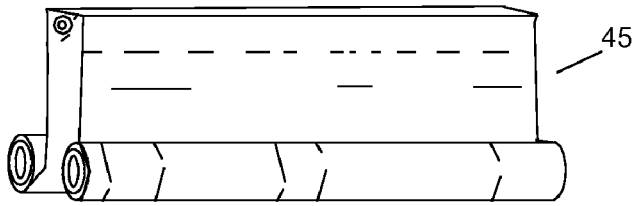
Fig. 11
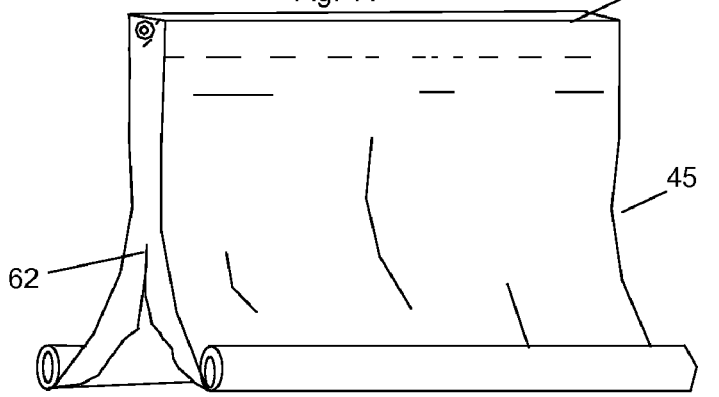
Fig. 12
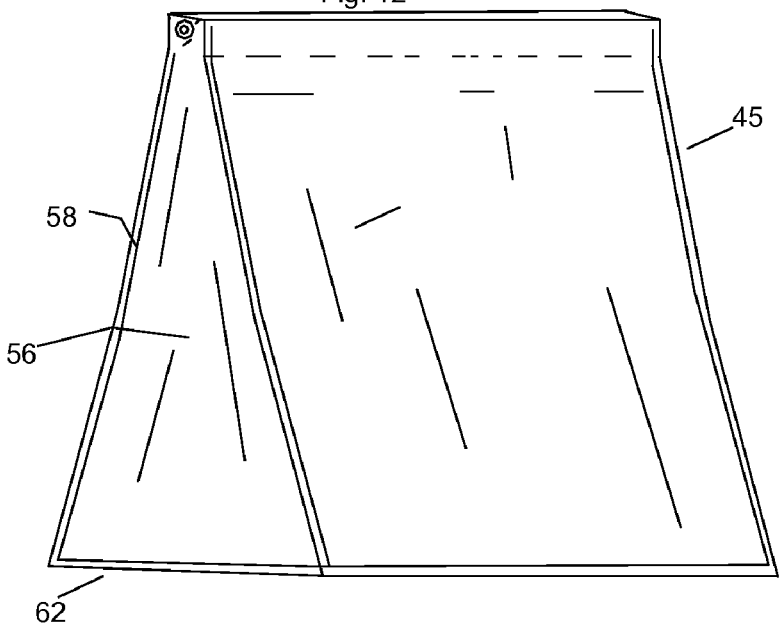

AUTOMATIC STOVE TOP FIRE EXTINGUISHER

CROSS-REFERENCE TO RELATED APPLICATIONS

Provisional Application No. 60/910,670, Apr. 8, 2007

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

This invention relates to a self contained, automatic stove top fire extinguisher, specifically to a more efficient method for isolating, containing, extinguishing and rendering a stove top fire incapable of re-igniting. This invention also utilizes a unique and precise method for extinguishing the stove top fire, that is normally grease.

2. The Prior Art

Heretofore, stove top fire extinguishers have used a chemical dispersal method that has lacked the ability to isolate a fire or confine it. The general chemical dispersal method is a less precise method. In the self contained units, the chemical dispersal method also has a limited amount of material to disperse.

Several prior U.S. patents use the vent hood mounted method for the installation of their apparatus. Most of these methods deliver a fire retardant chemical outside the boundary of the actual fire. It has been brought to mention in previous patents that the dispersal method increases the chances of "splashing" the burning grease, thereby spreading the flammable materials.

U.S. Pat. No. 6,276,461 B1 to Stager

Disadvantages

1. Irregular dispersal method or possible clogging of nozzles.

2. No isolation or containment of a grease fire.

U.S. Pat. No. 5,351,760 to Tabor. Jr.

Disadvantages

1. Possible clogging of spray nozzles or nozzle covers with cooking grease.

2. Complex installation required.

3. No isolation or containment of a grease fire.

Electrical supply required for fire suppressor to function.

U.S. Pat. No. 5,490,567 to Speer

Disadvantages

1. Must be manually applied to a grease fire.

2. No audible alarm

U.S. Pat. Nos. 4,773,485 and 4,834,188 to Silverman

Disadvantages

1. Unit is not self contained.

2. Complex installation required.

U.S. Pat. No. 3,653,443 to Dockery

Disadvantages

1. Complex installation required.

2. Electrical supply required for fire suppressor to function.

U.S. Pat. No. 3,209,837 to Freedman

Disadvantages

1. Extensive installation process requiring considerable space within hood.

2. Lack of complete isolation of fire.

3. Limited supply of retardant to disperse; possible re-ignition.

U.S. Pat. No. 4,580,638 to Jones

Disadvantages

1. Release of inert gas is not confined to targeted area to maintain fire suppression allowing for possible re-ignition of fire.

2. Electrical supply required for fire suppressor to function.

BRIEF SUMMARY OF THE INVENTION

The Automatic Stove Top Fire Extinguisher is a compact module that mounts above the stovetop, preferably within the cavity of a vent hood. When a grease fire occurs, a temperature sensitive fuse releases the spring loaded module halves. The spring forces the two halves of the cylinder module fully open. In so doing, another spring is released to force a pin into an inert gas cartridge within the module and sounds an audible alarm. This inert gas cartridge is internal to an inflatable bag that is comprised of a flame resistant material on four sides. Two of the available commercial materials for such use are manufactured by DuPont called Kevlar and Nomex. Another manufacturer, Thermal Material Systems, Inc. makes a number of variations of the product called Omnisil High Temperature Textiles. Example: "OS1200 Omnisil Woven Silica Cloth". These materials have been tested to withstand a temperature of 2000 degrees Fahrenheit for a period of 24 hours without changing their physical structure.

The bottom of the inflatable bag, being the exception, is comprised of a material that will intentionally decompose at the temperature of a grease fire. Upon inflation of the bag with inert gas, the bottom of the inflated bag that will decompose when exposed to the temperature of a grease fire is applied to the cooking container containing the burning grease. The bottom side decomposes releasing an absorbent fiber (Example: Thermal Materials Systems, Inc—Omnisil Chopped Fibers, ¼ inch to 1.0 inch length) into the pan containing the burning grease and also allows the inflatable flameproof sides of the bag to isolate the fire. The grease fire is now contained within the flame resistant compartment of the bag which is inflated with inert gas. The inert gas evacuates the oxygen necessary to support the grease fire and the absorbent fiber released from the decomposing bottom absorbs the grease contents, effectively reducing the grease capacity to reignite.

It is therefore an object of this invention to provide means, by which a self contained fire extinguishing module may isolate the fire, contain the high temperature of the grease fire, extinguish the fire and greatly diminish the flammable capabilities for the remaining grease of the stove top fire.

It is a further object of the invention to provide an automatic fire extinguishing module that may easily be adjusted for positioning, over the stove, by the average retail consumer.

It is also an object of this invention to provide means for an automatic audible alarm to be sounded when the stove top fire extinguisher is deployed.

It is another object of this invention to be completely self-contained without dependencies on outside power sources to operate properly and extinguish a stove top grease fire.

It is yet another object of this invention to avoid the unnecessary dispersal of excessive fire retardant chemicals onto surrounding areas of the stove, when the extinguisher is deployed.

In accord with these objects and others which will be discussed below, the fire extinguishing module of the present invention broadly comprises, within a vent hood mounted case, a thermal fuse (Example: Nylon cord) for melting when a grease fire temperature is present, the automatic mechanical opening of the mounted case and controlled inflation of a bag. The bag has flame resistant sides, a bottom that will decompose at a grease fire temperature only over the cooking container containing the fire and a layer of absorbent fibers inside the bottom layer. The bag to be filled with an inert gas and positioned onto the entire stove top surface while applying the absorbent fiber directly into the cooking container that contains the burning grease.

Additional preferred aspects of the system include the use of a thermal layer to protect the components internal to the module from ambient cooking heat.

Additional objects and advantages of the invention will become apparent to those skilled in the art upon reference to the detailed description taken in conjunction with the provided drawings.

BRIEF DESCRIPTION OF THE SEVERAL VIEWS OF THE DRAWING

FIG. 9, 10, 11, 12 is a sequence of four perspective views during flame resistant inflatable bag deployment with certain parts omitted for reasons of clarity.

FIG. 9 is a perspective view of the flame resistant inflatable bag prior to inflation.

FIG. 10 is a perspective view of the flame resistant inflatable bag partially inflated to demonstrate the approximate pattern of inflation of the top portion, to begin the unfolding of the bellows like folded portion during inflation.

FIG. 11 is a perspective view of the flame resistant inflatable bag demonstrating the bellows like folded portion completely unfolded and the beginning of the bottom center fold being pushed downward to demonstrate the approximate pattern of inflation during the continuation of the inflation process.

FIG. 12 is a perspective view of the flame resistant inflatable bag completely unfolded and inflated.

DETAILED DESCRIPTION OF THE INVENTION

Figure 2:
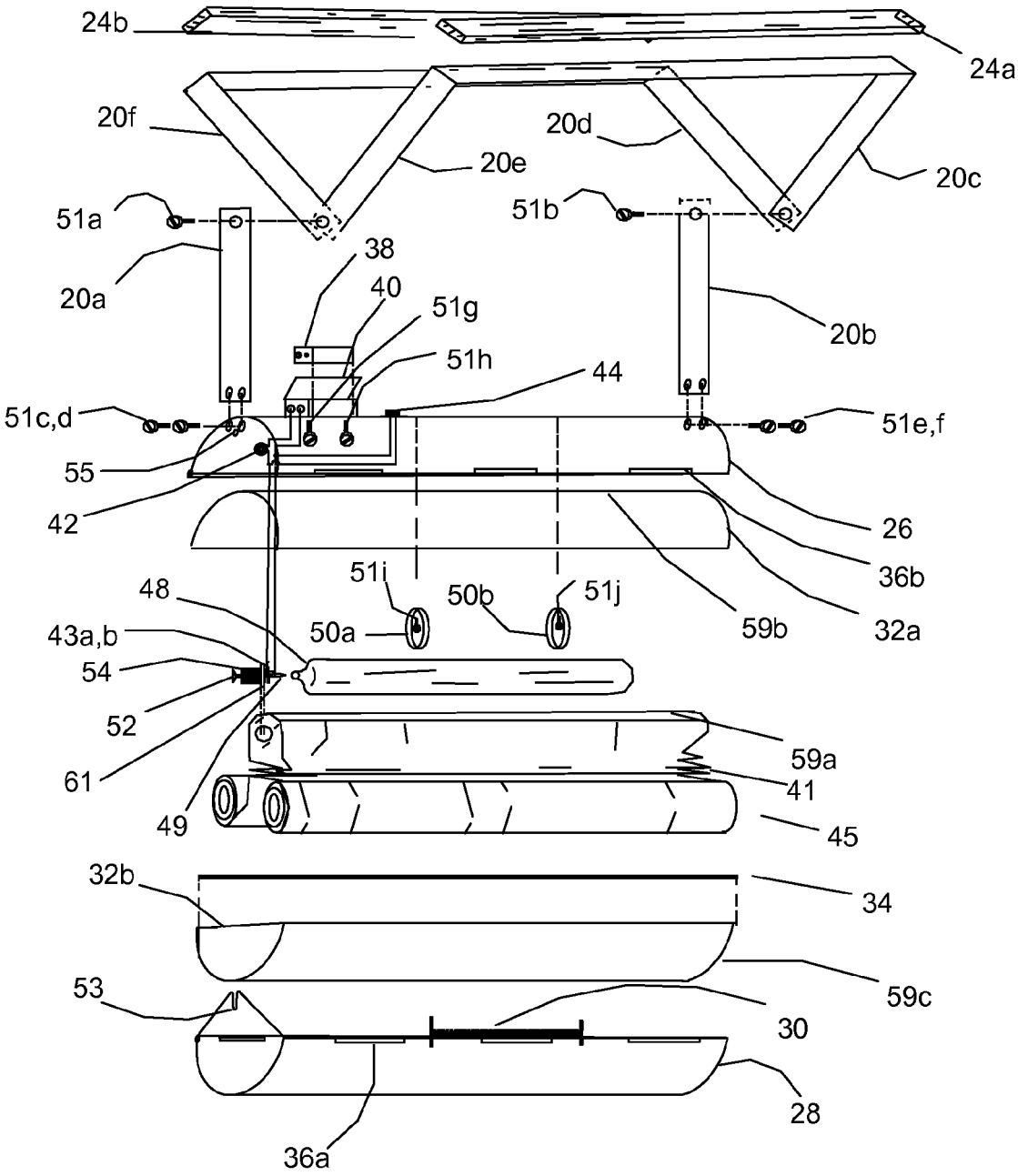
FIG. 2 is an exploded view of a preferred form of the Automatic Stove Top Fire Extinguisher before deployment.
Figure 3:
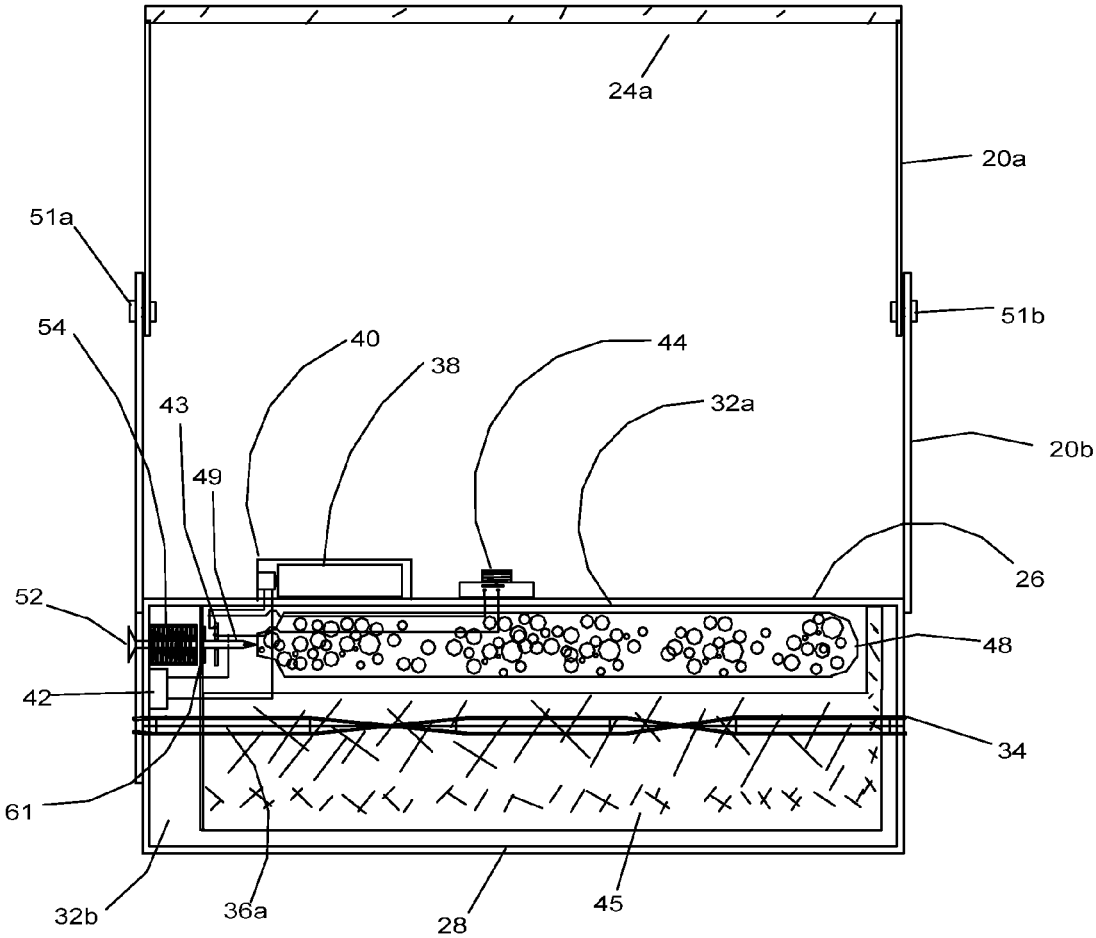
FIG. 3 is a front plan view of a preferred form of the Automatic Stove Top Fire Extinguisher in its entirety, before deployment.
Figure 4:
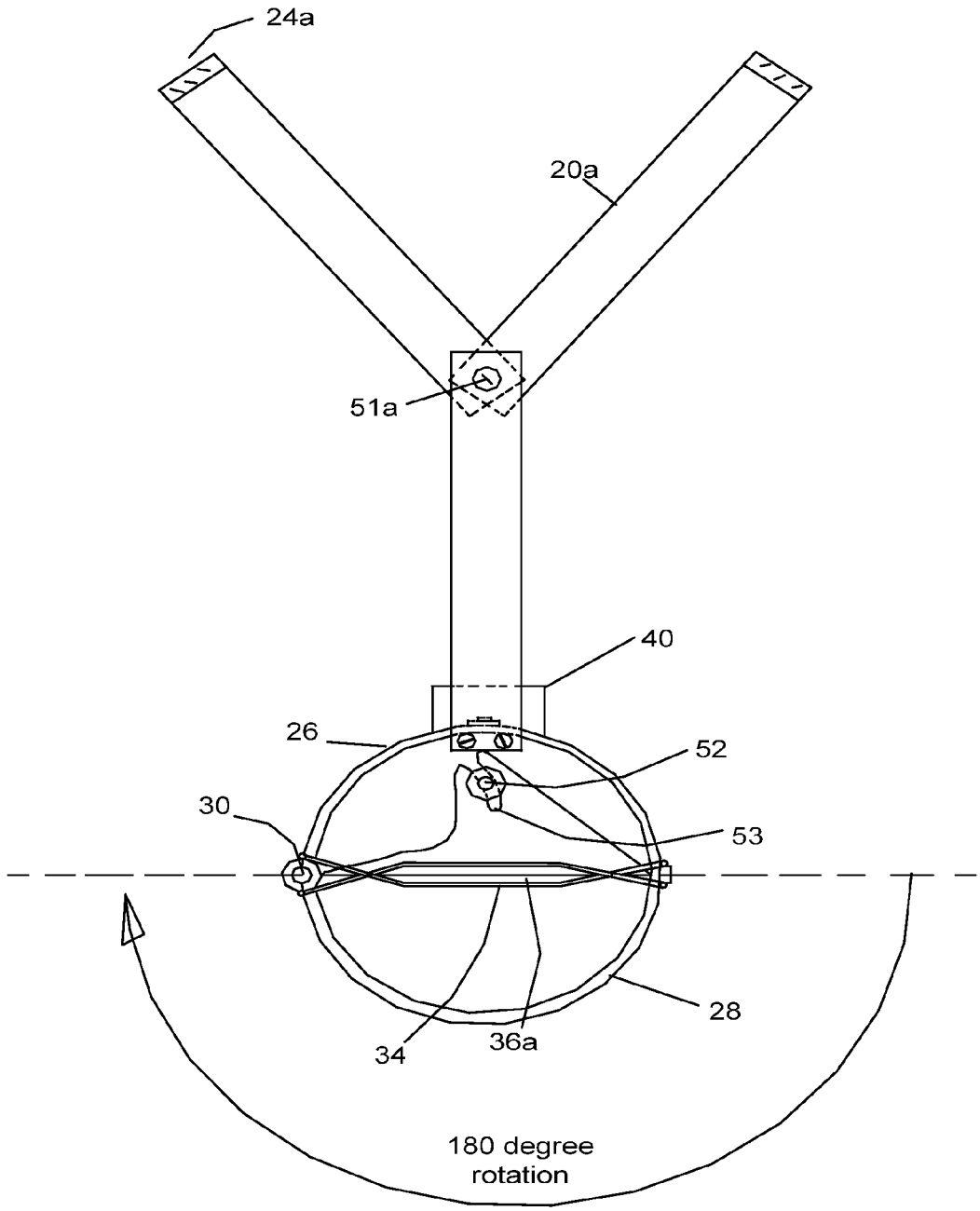
FIG. 4 is a left hand, end view of the Automatic Stove Top Fire Extinguisher before deployment with certain parts being omitted for reasons of clarity.
Figure 6:
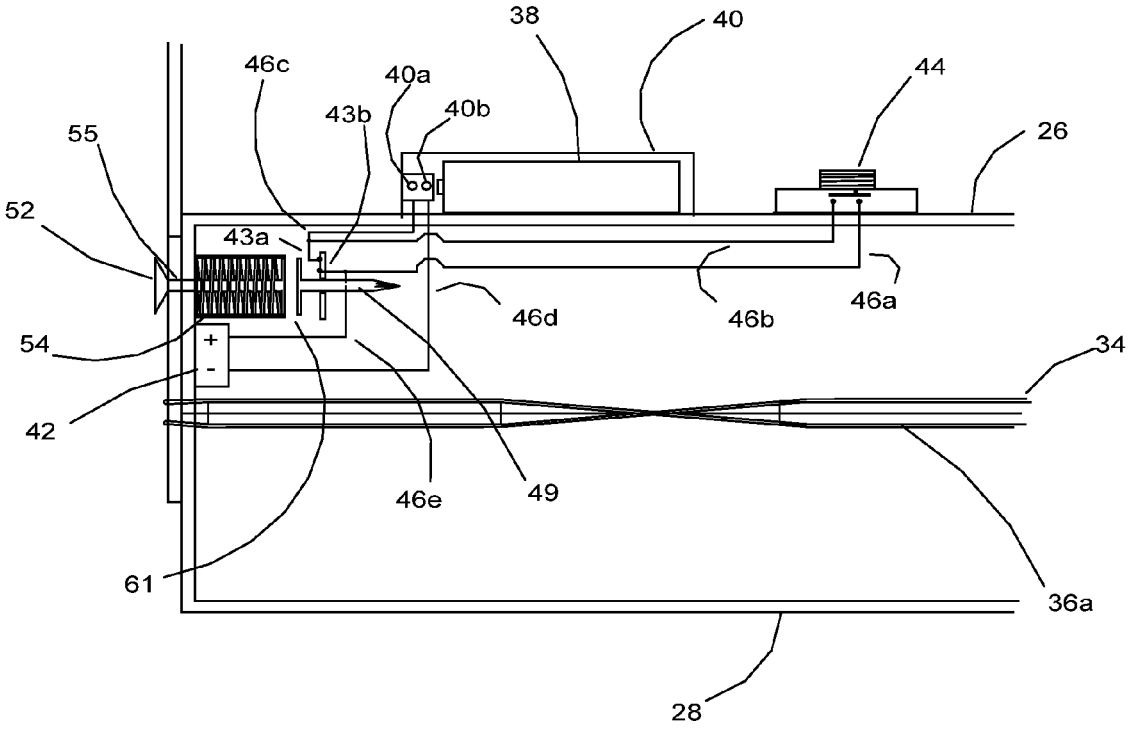
FIG. 6 is an enlarged front plan partial view, in detail, of some of the components internal to the Automatic Stove Top Fire Extinguisher prior to deployment.
Figure 7:
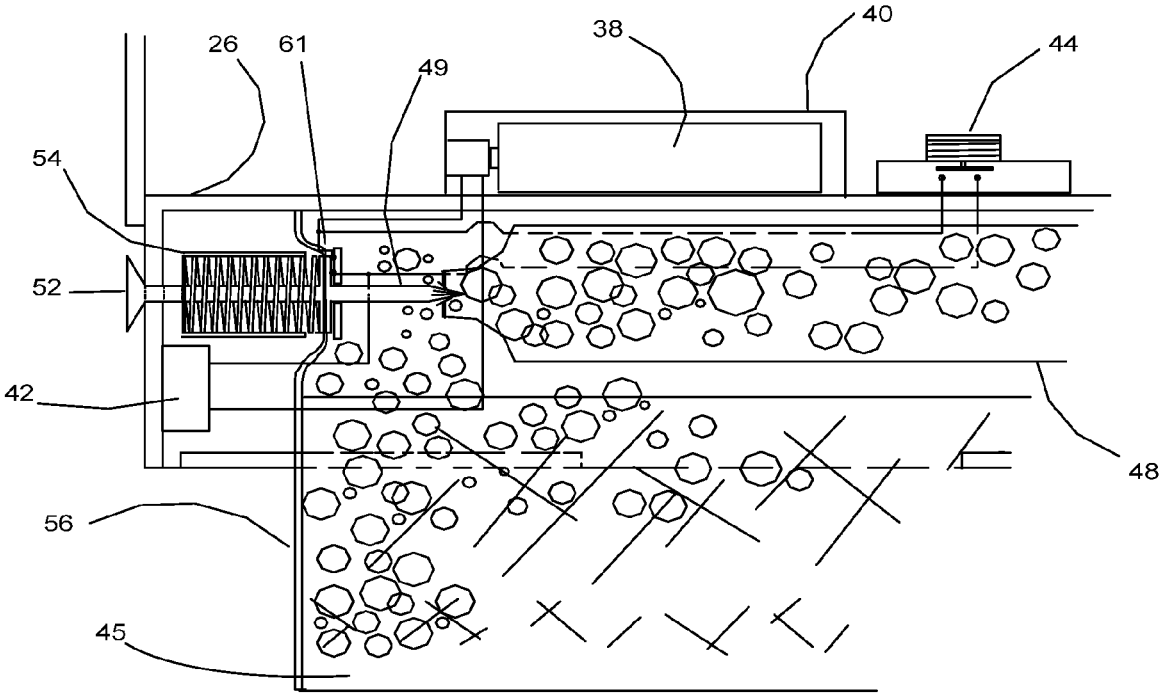
FIG. 7 is an enlarged front plan partial view, in detail, of additional components internal to the Stove Top Fire Extinguisher after deployment.

FIG. 2 is comprised of a magnetic strip 24*a* and a magnetic strip 24*b*. The magnetic strips 24*a* and 24*b* are attached to a plurality of metal bracket straps 20*a* through 20*f*. The metal bracket straps 20*a* through 20*f* connect with a plurality of screws 51*a* to 51*f*. The metal bracket straps 20*a* through 20*b* are affixed to each end of case top half 26. The case top half 26 and a case bottom half 28 are held together by a case spring hinge 30 and held closed by a fusible cord 34 and a fuse cord mount 36*a* and a fuse cord mount 36*b*. A case insulation 32*a* and 32*b* and the top four sides that encompass an inert gas cartridge 48 of inflatable bag 45 are held in place by glue 59*a* through 59*c* internal to case top half 26 and case bottom half 28. A battery box 40 is attached to case top half 26 with screws 51*g* and 51*h*. Battery box 40 holds a battery 38. In FIG. 6 a positive battery terminal 40*a* and a negative battery terminal 40*b* are wired to an alarm 42, a test button 44 and a wiring contacts 43*a* and a wiring contact 43*b* by a plurality of electrical wire 46*a* through 46*e*. A puncture pin 52 of FIG. 2 is held in the end of case top half 26 through a puncture pin hole 55 with a puncture pin spring 54 on the inside of case top half 26. A secondary puncture pin 49 attaches to the puncture pin 54. Puncture pin 52 is also through a notch 53 on the end of case bottom half 28. I Inert gas cartridge 48 is held in position by clamps 50*a* and 50*b*. Clamps 50*a* and 50*b* are held to case top half 26 with screws 51*i* and 51*j*. Inflatable bag 45 comprises a flame resistant cloth 56 in FIG. 8, a plurality of flame resistant threads 58, a layer of absorbent fibers 60, a fusible bag bottom 62, and a plurality of flame resistant cords 57*a* through 57*d*.

Operation of Invention—FIGS. 1, 2, 3, 4, 5, 6, 7, 8, 9

Figure 1:
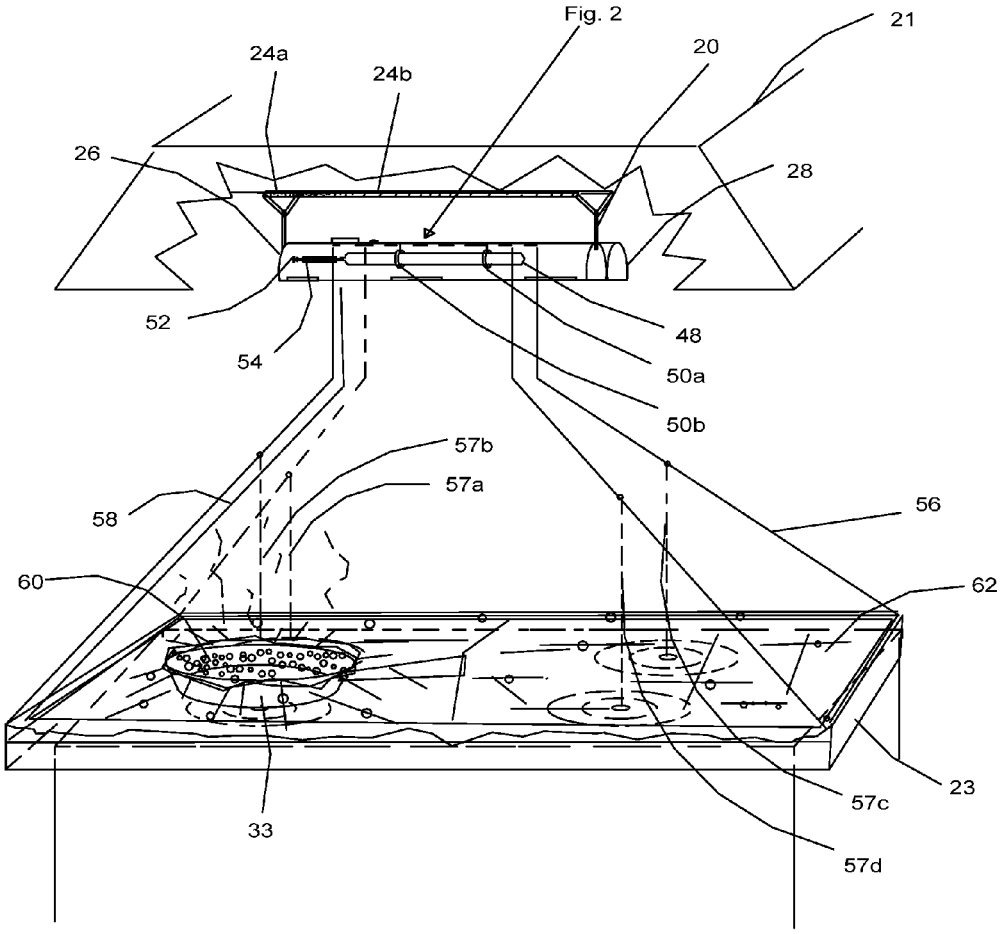
FIG. 1 is a perspective of the front elevation view of a stove having a vent hood containing a preferred embodiment of my extinguisher after inflation. It is also, an example of a cooking container containing grease that has caught on fire.
Figure 8:
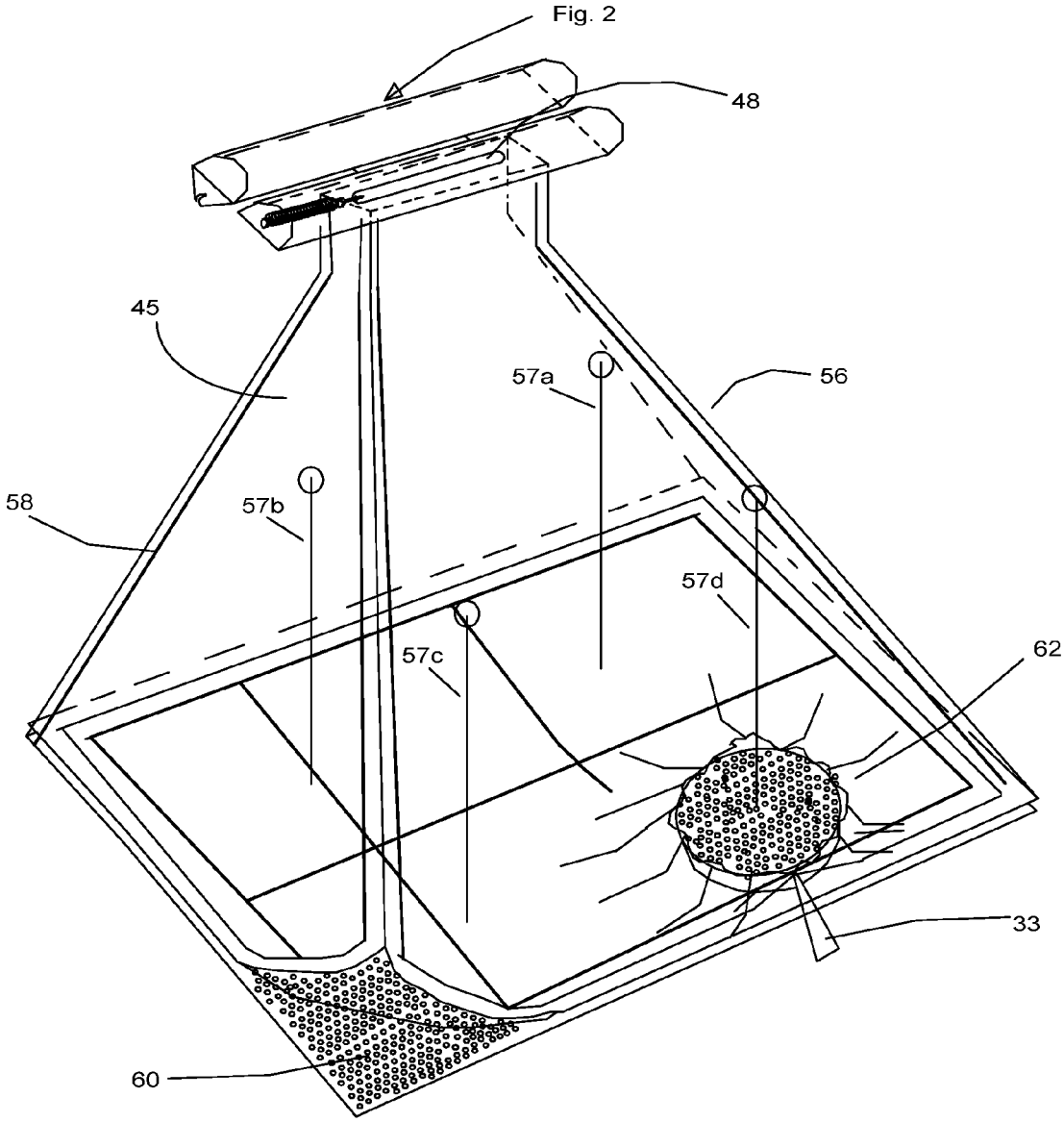
FIG. 8 is a perspective view of the inflated flame resistant bag deployed from within the Automatic Stove Top Fire Extinguisher to show the final shape, coverage of the stove top and the internal layer of non-flammable absorbent fibers. Also to show how a high temperature grease fire will decompose the temperature sensitive bag bottom, apply the non-flammable fibers directly into the cooking container containing the fire and isolate the fire completely.

The Stove Top Fire Extinguisher in FIG. 1 is positioned in a vent hood 21 above and centrally disposed over the gas burners or electric elements of a stove top 23 by means of magnetic strips of FIG. 2, 24*a* and 24*b* on the metal bracket straps 20*c*, 20*d*, 20*e* and 20*f*. Metal bracket straps 20*c* through 20*f* are attached to metal bracket straps 20*a* and 20*b* for adjustment of module position. Metal bracket straps 20*a* and 20*b* are attached to case top half 26. The method used by the automatic stove top fire extinguisher isolates, contains and extinguishes a stove top grease fire and renders the grease fire incapable of re-igniting as shown in FIG. 1 and FIG. 8.

Figure 5:
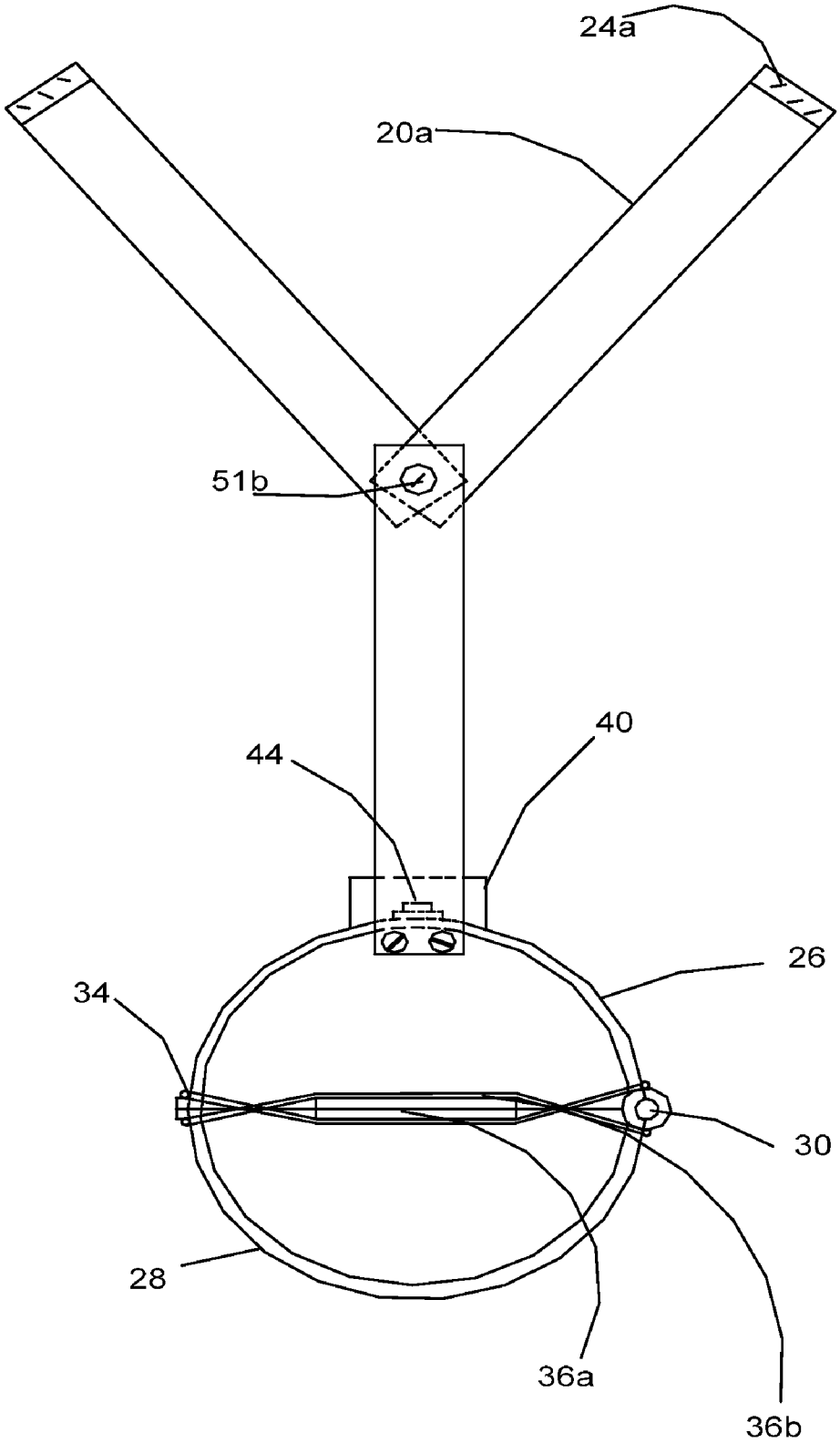
FIG. 5 is a right hand end view of the Automatic Stove Top Fire Extinguisher before deployment with certain parts being omitted for reasons of clarity.

Fusible cord 34 of FIG. 5 is secured in place by fuse cord mount 36*b* of case top half 26 and fuse cord mount 36*a* of case bottom half 28 and case spring hinge 30. A cooking container 33 in FIG. 1 with a grease fire melts fusible cord 34 of FIG. 2 that holds case spring hinge 30 of case top half 26 and case bottom half 28 closed. After fusible cord 34 of FIG. 4 has melted (approximately 768 F.), case spring hinge 30 forces case bottom half 28 to open in a circular motion to the back and with 180 degrees of rotation. As case bottom half 28 rotates open, notch 53 of case bottom half 28 allows puncture pin spring 54 of FIG. 7 to force puncture pin 52 to push secondary puncture pin 49 for penetration of inert gas cartridge 48. I Inert gas cartridge 48 inflates inflatable bag 45.

The action of secondary puncture pin 49 and inert gas cartridge 48 gas release are demonstrated. Puncture pin 52 passes the energy of puncture pin spring 54 to secondary puncture pin 49 by closing gap 61. Gap 61 has one section of inflatable bag 45 flame resistant cloth 56 within it. Flame resistant cloth 56 is slack enough to allow the movement of secondary puncture pin 49. This method allows inert gas cartridge 48 to be internal to inflatable bag 45 without puncture pin 52 penetrating inflatable bag 45 wall. FIG. 9 through FIG. 12 demonstrates the inflation sequence and starts with inflatable bag 45 of FIG. 9 having the upper portion of the top four sides of inflatable bag 45 of FIG. 9 bellows like folded 41 of FIG. 9 and encompassing inert gas cartridge 48 of FIG. 2. Attachment to case top half 26 of FIG. 2 with glue 59*a* of FIG. 2 forms the sealed inflatable bag 45 of FIG. 12. Fusible bag bottom 62 of FIG. 11 of inflatable bag 45 of FIG. 11 is folded lengthwise and vertically in the center with the ends of inflatable bag 45 folded to a predetermined dimension inwardly and vertically allowing the longer sides of the inflatable bag 45 to be rolled up. Inflation will first unfold, extending in a downward direction, the top bellows like folded 41 of FIG. 9 upper portion of inflatable bag 45 of FIG. 10. Then unrolling the sides while extending the inward folds of the ends and forcing downward the predetermined lengthwise and upward fold of fusible bag bottom 62 of FIG. 11 to deploy inflatable bag 45 of FIG. 11 and complete the deployment of inflatable bag 45 of FIG. 12. Inflatable bag 45 of FIG. 8 has flame proof cords 57*a*, 57*b*, 57*c*, and 57*d* to add structure to the fusible bag bottom 62 of FIG. 8 to maintain the predetermined shape. The temperature sensitive fusible bag bottom 62 decomposes and allows cooking container 33 to become internal to flame resistant inflatable bag 45. The fire is thereby surrounded by flame resistant cloth 56 and the gas from inert gas cartridge 48 to extinguish the fire. Fusible bag bottom 62 decomposes at the temperature of a typical grease fire (approximately 768 F.) and has a layer of non-flammable absorbent fibers 60 that are released and absorb the flammable grease thereby preventing the cooking grease from re-igniting.

The automatic stove top fire extinguisher incorporates the use of the battery 38 of FIG. 6 to power alarm 42. When case top half 26 and case bottom half 28 are opened, puncture pin 52 is pushed by puncture pin spring 54 into secondary puncture pin 49 which is pushed to wiring contacts 43*a* and 43*b* to complete the circuit to battery 38 and alarm 42. In the event battery 38 is removed or too weak to power alarm 42, alarm 42 will not sound, however, the Automatic Stove Top Fire Extinguisher is mechanical and will retain all of its fire extinguishing capabilities.

The positive battery terminal 40*a* of battery 38 is connected to wiring contact 43*a*. The other side of wiring contact 43*b* is connected to the positive side of alarm 42. The negative side of alarm 42 is connected directly to negative battery terminal 40*b* of battery 38. Test button 44 is connected to wiring contacts 43*a* and 43*b*. When the extinguisher is deployed, secondary puncture pin 49 is forced into wiring contacts 43*a* and 43*b* to complete the circuit from battery 38 to alarm 42. Pressing test button 44 simulates secondary puncture pin 49 completing the circuit by shorting wiring contacts 43*a* and 43*b* together to complete the circuit and test alarm 42.

RAMIFICATIONS AND SCOPE OF THE INVENTION

Thus the reader will see that the Automatic Stove Top Fire Extinguisher of the invention provides an easily understood and mounted module for the user. The extinguisher may be used for other applications such as recreational vehicles, restaurants and boats. Any enclosure that allows the possibility of catching on fire may benefit from the use of this invention in alternative configuration. While my description above contains specificities, these should not be construed as limitations on the scope of the invention, but rather as an exemplification of one preferred embodiment thereof. Many other variations are possible. For a more complex version, an electrical extension or a mechanical release for the module may also be used to disconnect the supply line for the gas or electricity supplying the energy for the stove. Other additions possible to improve the performance of the Automatic Stove Top Fire Extinguisher may include another coating of smoke absorbing material, inside the inflatable bag to diminish the result of smoke damage from stove top fires. Another possibility would be the use of a non flammable foam or inert material to inflate the flame proof bag versus the inert gas. Yet another configuration would be the use of an absorbent chemical such as Borax in the bottom layer of said bag. Still another method would be the use of a flame proof, yet absorbent material on said bag bottom that remains intact to suffocate the grease fire, versus the use of the decomposable material for the bag bottom.

REFERENCE NUMERALS IN DRAWINGS

20*a*-20*f* Metal Bracket Straps
21 Vent Hood
23 Stove Top
24*a*-24*b* Magnetic Strips
26 Case Top Half
28 Case Bottom Half
30 Case Spring Hinge
32*a*-32*b* Case Insulation
33 Cooking Container
34 Fusible Cord
36*a*-36*b* Fuse Cord Mounts
38 Battery
40 Battery Box
40*a* Positive Battery Terminal
40*b* Negative Battery Terminal
41 Bellows Like Folded
42 Alarm
43*a*, 43*b* Wiring Contacts
44 Test Button
45 Inflatable Bag
46*a*-46*e* Electrical Wire
48 Inert Gas Cartridge
49 Secondary Puncture Pin
50*a*-50*b* Clamps
51*a*-51*j* Screws
52 Puncture Pin
53 Notch
54 Puncture Pin Spring
55 Puncture Pin Hole
56 Flame Resistant Cloth
57*a*-57*d* Flame Resistant Cords
58 Flame Resistant Threads
59*a*-59*c* Glue
60 Absorbent Fibers
61 Gap
62 Fusible Bag Bottom Having described my invention, I claim:

1. An automatic stove top fire extinguisher, comprising:

a flame resistant inflatable bag having a plurality of sides;

an inert gas cartridge for inflating said flame resistant inflatable bag to a predetermined shape;

a case having a plurality of sections for storing said flame resistant inflatable bag in a folded condition and said inert gas cartridge, said case being positioned over a stove top and attached to a hood, said hood having a closed top, vertical side walls and an open bottom;

a release means for penetrating said inert gas cartridge within said case for inflation of said flame resistant inflatable bag;

a fire responsive control means external to said case for detecting the presence of a grease fire on said stove top and to thereby facilitate opening of said case;

an audible alarm that sounds when said case opens; and a means for attaching said case to said hood, whereby said automatic stove top fire extinguisher when deployed will isolate said grease fire, contain said grease fire and extinguish said grease fire, thereby rendering said grease fire incapable of re-igniting.

2. The stove top fire extinguisher of claim 1, wherein said flame resistant inflatable bag is constructed of a flame resistant cloth, a plurality of flame resistant cords, a plurality of flame resistant threads, and a fusible bag bottom.

3. The stove top fire extinguisher of claim 2, wherein said fusible bag bottom is constructed of two layers of material that decompose, at a temperature of said grease fire, and a third internal layer sandwiched between the two layers of decomposable material, constructed of a layer of non-flammable absorbent fibers.

4. The stove top fire extinguisher of claim 1, wherein said folded condition includes sides of said flame resistant inflatable bag being bellows like folded within said case and encompassing said inert gas cartridge, wherein said plurality of sections of said case includes a case top half and a case bottom half, and wherein said flame resistant inflatable bag is attached to said case top half with glue to form a sealed upper portion of said flame resistant inflatable bag.

5. The stove top fire extinguisher of claim 4, wherein said folded condition further includes a fusible bag bottom being folded lengthwise and vertically upward in a center thereof with ends of said flame resistant inflatable bag being folded to a predetermined dimension inwardly and vertically upward allowing a bottom portion of opposing sides of the inflatable bag to be rolled up.

6. The stove top fire extinguisher of claim 1, wherein said release means comprises a puncture pin spring that forces a puncture pin to push a secondary puncture pin for penetration of said inert gas cartridge.

7. The stove top fire extinguisher of claim 1, wherein said case consists of a case top half and a case bottom half attached thereto with a case spring hinge.

8. The stove top fire extinguisher of claim 1, wherein said fire responsive control means comprises a heat responsive member adapted to facilitate the opening of said case.

9. The stove top fire extinguisher of claim 8, wherein said heat responsive member adapted to facilitate the opening of said case comprises a fusible cord mounted with a fuse cord mount on said case.

10. The stove top fire extinguisher of claim 1, wherein said audible alarm comprises a battery, a battery box and a test button connected to wiring contacts.

11. The stove top fire extinguisher of claim 7, wherein said means for attaching said case to said hood comprises a plurality of magnetic strips and a plurality of adjustable metal brackets attached to said case top half.

12. A method of isolating a grease fire, containing said grease fire and extinguishing said grease fire, while rendering said grease fire incapable of re-igniting, said method employing a self contained automatic stove top fire extinguisher comprising:

a flame resistant inflatable bag having a plurality of sides constructed of flame resistant material, and a fusible bag bottom constructed of two layers of decomposable material and a third interior layer constructed of a layer of non-flammable absorbent fibers sandwiched between said two layers of decomposable material;

an inert gas cartridge for inflating said flame resistant inflatable bag to a predetermined shape;

a case having a plurality of sections for storing said flame resistant inflatable bag in a folded condition and said inert gas cartridge, said case being positioned over a stove top and attached to a hood, said hood having a closed top, vertical side walls and an open bottom;

a release means for penetrating said inert gas cartridge within said case for inflation of said flame resistant inflatable bag;

a fire responsive control means external to said case for detecting the presence of a grease fire on said stove top and to thereby facilitate opening of said case;

an audible alarm that sounds when said case opens; and a means for attaching said case to said hood, said method comprising the steps of:

positioning said automatic stove top fire extinguisher inside the walls of said hood mounted over said stove top;

holding said case closed, with a fusible cord of said fire responsive control means, said fusible cord having a predetermined melting temperature;

opening said case automatically when said grease fire reaches said predetermined melting temperature;

inflating said flame resistant inflatable bag with inert gas from said inert gas cartridge, thereby covering said grease fire with said flame resistant inflatable bag;

releasing said layer of non-flammable absorbent fibers and directly depositing said non-flammable absorbent fibers into said grease fire upon a decomposition of said fusible bag bottom at a grease fire temperature;

allowing said grease fire to enter said fusible bag bottom, whereby the inert gas inflated flame resistant bag isolates said grease fire from other portions of said stove top and contains said grease fire thereby depriving said grease fire of necessary oxygen and extinguishing said grease; and containing the extinguished grease fire with said inflated bag and said inert gas, while said fusible bag bottom continues to decompose and deposit said layer of non-flammable absorbent fibers directly into the extinguished grease fire without dispersing chemicals at random, whereby said grease fire is isolated, contained and extinguished, thereby rendering said grease fire incapable of re-igniting.

13. The method of claim 12, wherein said fusible bag bottom decomposes at said grease fire temperature to deposit said layer of non-flammable absorbent fiber precisely where it will be most effective, in said grease fire and prevent random distribution of said layer of non-flammable absorbent fibers.

* * * * *